United States Patent [19]

McBride, Jr.

[11] 4,279,388

[45] Jul. 21, 1981

[54] COMBINATION MOUNTING BRACKET, BALL TENSION AND BALLOON CONTROL DEVICE

[76] Inventor: Edward J. McBride, Jr., P.O. Box 311, Moorestown, N.J. 08057

[21] Appl. No.: 180,164

[22] Filed: Aug. 21, 1980

Related U.S. Application Data

[63] Continuation of Ser. No. 29,220, Apr. 12, 1979, abandoned.

[51] Int. Cl.[3] ..... B65H 59/22

[52] U.S. Cl. ..... 242/152.1; 242/131

[58] Field of Search ..... 242/152.1, 147 R, 149, 242/150 R, 150 M, 151, 153, 154, 155 R, 155 M, 157 R, 131, 131.1; 57/352, 354

[56] References Cited

U.S. PATENT DOCUMENTS

| | | | |
|---|---|---|---|
| 2,393,995 | 2/1946 | Lambach et al. | 242/154 |
| 2,597,044 | 5/1952 | Warwick | 242/150 R |
| 2,689,449 | 9/1954 | Clarkson . | |
| 3,011,736 | 12/1961 | Furst et al. | |
| 3,304,027 | 2/1967 | Stanier | 242/150 R |
| 3,338,042 | 8/1967 | Vibber . | |
| 3,339,358 | 9/1967 | Vibber . | |
| 3,340,686 | 9/1967 | Vibber . | |
| 3,559,916 | 2/1971 | Hilscher | 242/154 |
| 3,568,949 | 3/1971 | Riha et al. | |
| 3,753,535 | 8/1973 | Zollinger | 242/152.1 |
| 4,019,701 | 4/1977 | McCullough | 242/152.1 |

FOREIGN PATENT DOCUMENTS

| | | | |
|---|---|---|---|
| 892912 | 4/1962 | United Kingdom | 242/150 R |
| 907062 | 10/1962 | United Kingdom | 242/154 |

*Primary Examiner*—Stanley N. Gilreath

*Attorney, Agent, or Firm*—Weiser, Stapler & Spivak

[57] ABSTRACT

A combination mounting bracket, ball tension and balloon control comprising a unitary mounting arm and balloon control disk for use on creels of warping, winding, beaming, weaving and other types of high speed textile machines. The device includes provision for either right hand or left hand mounting of a ball tension which functions in cooperation with the balloon control to feed the yarn to the machine.

6 Claims, 4 Drawing Figures

COMBINATION MOUNTING BRACKET, BALL TENSION AND BALLOON CONTROL DEVICE

This is a continuation of application Ser. No. 29,220, filed Apr. 12, 1979, now abandoned.

BACKGROUND OF THE INVENTION

The present invention relates generally to yarn control devices, more particularly, is directed to a combination mounting bracket, balloon control and ball tension suitable to control the feed of the yarn to a textile machine.

In most high speed, modern textile machines, such as warping, winding, beaming, slashing, weaving and other types of machines, it is the common practice to employ creels to feed yarn to the device through a suitable tensioning means, for example ball tension devices.

While ball tension devices have generally proved highly satisfactory to properly tension a yarn as it feeds to the textile machine, in many high speed applications, the prior art ball tension devices could not be effectively utilized because of the high speed of yarn travel and the tendency to build up harmonic vibrations in the yarn. In fact, prior workers in the art have found it almost impossible to effectively employ a ball type yarn tensioning device in conjunction with high speed warping creels.

Additional problems occasioned by the yarn ballooning have also plagued the yarn feed designs developed in conjunction with various textile machines. Often, even where a ball tension device could be effectively employed, the ballooning pattern of the yarn after periods of use or the excited state of the yarn as it comes off the yarn package has been known to cause tangles, breakage or other undesirable effects.

Different yarn packages generally create different balloon patterns, which patterns can be a function of the speed of operation, and the geometry of the system. Prior workers in the art have generally employed cup type balloon control constructions but one general design has not proved suitable for general application in conjunction with all types of machines. U.S. Pat. Nos. 3,339,358, 3,011,736, 3,568,949, 3,338,042, 2,689,449 and 3,340,686 are all of interest and generally show the use of a cup shaped or bell shaped body through which the yarn passes for balloon control purposes. However, no single design has been found suitable for general application.

SUMMARY OF THE INVENTION

The present invention relates generally to equipment suitable for use in warping, weaving and winding devices, and more particularly, is directed to a balloon control mounting bracket suitable for general application to a great variety of devices.

The bracket of the present invention comprises a channel shaped or L-shaped bracket including means to securely affix the bracket to the permanent construction members of the associated warping, weaving or winding machine. A circular or disk-like balloon control shield is permanently affixed to the bracket near one end thereof and includes a concentric yarn passageway or conduit to lead the yarn through the balloon control disk and the associated leg of the bracket. Mandatorily, the yarn conduit is relatively elongated in comparison to the diameter of the yarn and best results are obtained when the conduit is between at least about $\frac{5}{8}$ of an inch in length to at least about $\frac{3}{4}$ of an inch in length. The diameter of the conduit should be sufficient to facilitate passage of the yarn therethrough without binding. For example, a 3/16 inch diameter opening has been found suitable for most yarns.

The elongated yarn conduit acts to remove harmonic vibrations from the yarn as it passes through the conduit and before the yarn reaches the associated ball tension device which will hereinafter be more fully discussed. Additionally, the balloon control disk and the yarn conduit serve to prevent ballooning yarn from winding about or otherwise becoming entangled with an exposed yarn tension device.

The combination mounting bracket and balloon control functions to ready the yarn to enter the ball tension device in a less excited state than would be possible when the yarn is fed directly off of the yarn package. It will be noted that different yarn packages create different balloon patterns. The balloon disk or circular balloon shield of the present device is suitable to control the various yarn patterns inherent with all different yarn packages.

In the preferred embodiment, the mounting bracket is designed to be suitable for either right hand mounting or left hand mounting to thereby render the device substantially universal in application and suitable for use with substantially all yarn handling machines. Means are provided to accommodate a yarn tension device, such as a ball tension device in longitudinally offset relationship to the balloon control disk. In the preferred embodiment, the center of the ball tension device is located approximately two inches from the center of the balloon control disk.

The ball tension device may be mounted at right angles to the longitudinal extension of the mounting bracket or may be otherwise angularly inclined as dictated by the configuration of the machine with which the device is utilized. Preferably, the yarn, after the harmonic vibrations have been dampened, enters the ball tension device at a gentle angle and leaves the ball tension device at a gentle angle, for example in the case of horizontal ball tension devices, at an angle less than 35° from the yarn path defined through the aligned yarn openings.

The combination mounting bracket, balloon breaker and yarn tension of the present invention allows the use of a ball tension device with high speed yarn handling equipment, such as high speed warping creels in a manner never heretofore possible with previously existing equipment.

It is therefore an object of the present invention to provide an improved combination mounting bracket, balloon control and yarn tension device.

It is another object of the present invention to provide a novel mounting bracket, balloon control and yarn tension device including universal construction suitable to facilitate use with an extremely wide variety of yarn handling machines.

It is another object of the present invention to provide a novel combination mounting bracket, balloon control and ball tension device capable of controlling a wide variety of balloon patterns from different yarn packages.

It is another object of the present invention to provide a novel combination mounting bracket, balloon control and ball tension device capable of removing harmonic vibrations from yarn in a high speed machine before the yarn reaches the ball tension device.

It is another object of the present invention to provide a novel combination mounting bracket, balloon control and ball tension device including means to ready the yarn to enter the ball tension device in a less excited state than when the yarn is fed from the yarn package.

It is another object of the present invention to provide a novel combination mounting bracket, balloon control and ball tension device that is inexpensive in manufacture, universal in application and trouble free when in use.

Other objects and a fuller understanding of the invention will be had by referring to the accompanying description and drawings wherein similar reference numerals designate similar parts throughout and in which:

DESCRIPTION OF THE PREFERRED EMBODIMENT OF THE INVENTION

Figure 1:
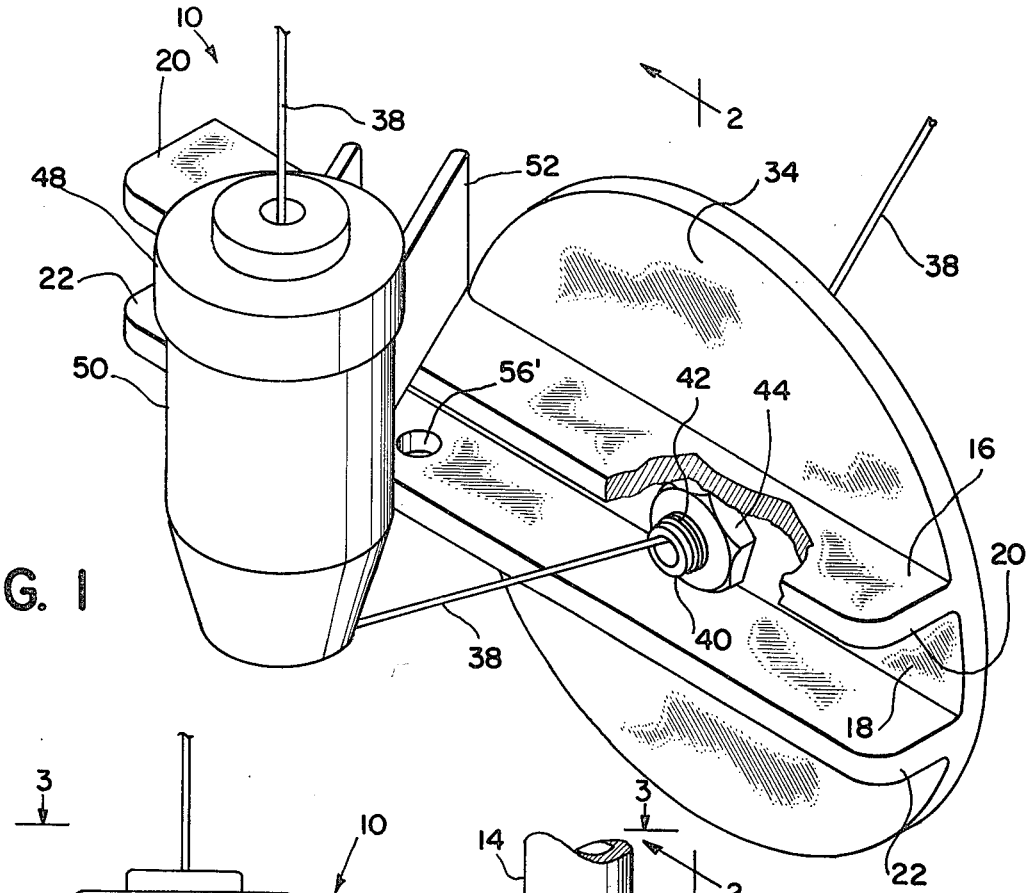
FIG. 1 is an isometric view of the combination mounting bracket, balloon control disk and ball tension device of the present invention, partly broken away to expose construction details.
Figure 2:
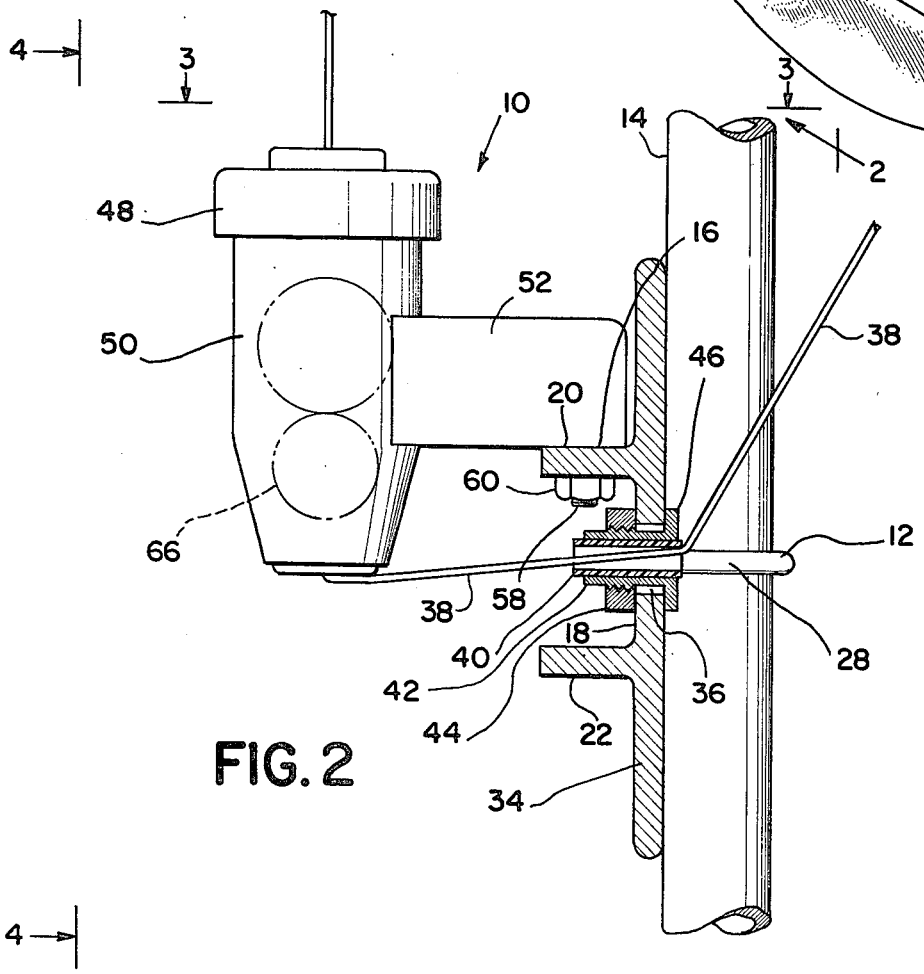
FIG. 2 is a cross sectional view taken along line 2—2 of FIG. 1, looking in the direction of the arrows.
Figure 3:
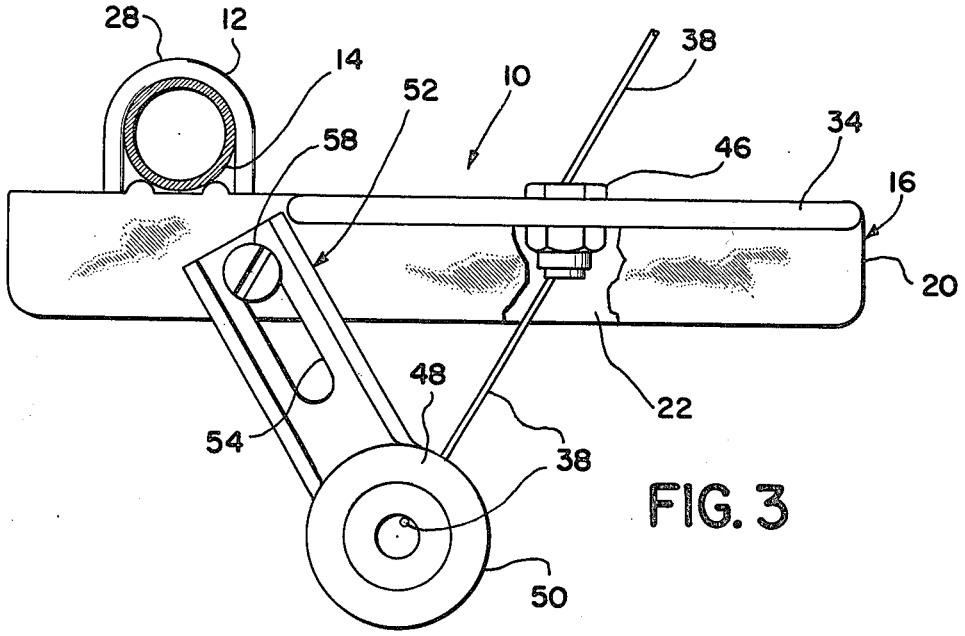
FIG. 3 is a top plan view of the device, looking from line 3—3 on FIG. 2.

Although specific terms are used in the following description for the sake of clarity, these terms are intended to refer only to the particular structure of the invention selected for illustration in the drawings and are not intended to define or limit the scope of the invention.

Referring now to the drawings, a combination mounting bracket, balloon control and ball tension device generally designated 10 is illustrated. The bracket is provided with suitable clamping means 12 to engage the device securely to a permanent member 14 of an associated yarn processing machine. The attaching means 12 may be a suitable pipe clamp or other known clamping construction as necessary to securely affix the device 10 to the permanent machine member 14.

The device comprises a mounting bracket means including a mounting bracket 16 of elongate construction that preferably is channel-shaped in cross sectional configuration, although other cross sectional shaped brackets such as L-shaped could also be employed. The mounting bracket 16 includes a web section 18 which usually is vertically oriented and which terminates upwardly in a horizontal upper leg 20 and downwardly in a horizontal lower leg 22. The web 18 may be drilled or otherwise worked to provide openings 24, 26 through which the attaching means 12 can insert in order to affix the device 10 to the permanent machine member 14. In the embodiment illustrated, the attaching means 12 comprises a U-shaped bolt 28 which secures in place utilizing the tightening nuts 30, 32 in well known manner.

A balloon control means comprising a disk or circular balloon breaker 34 affixes to the web 18 of the mounting bracket 16 near one lateral edge thereof in permanent manner such as by spot welding, adhesives or bolts. As illustrated, a concentric opening 36 is provided through the combination disk 34 and web 18 to allow passage of the yarn 38 therethrough in the manner hereinafter more fully set forth. Alternately, the balloon control disk and mounting bracket may be molded or otherwise formed of unitary construction.

It has been found desirable to line the opening 36 with a length of hard, smooth, hollow, cylindrical, ceramic conduit 40 to facilitate passage of the yarn therethrough without noticeable wear or other deterioration of the device. The conduit 40 may be secured within the opening 36 in a suitable manner, such as by utilizing a threaded bushing 42 with integral head 46 secured in place with a suitable lock nut 44. Preferably, the ceramic conduit 40 should be between $\frac{5}{8}$ inches and $\frac{3}{4}$ of an inch in length and the central opening therethrough should be on the order of 3/16 of an inch. It has been found that if the conduit 40 is substantially less than $\frac{5}{8}$ of an inch in length, it will not serve to dampen harmonic vibrations in the yarn as it is fed through the apparatus. The construction incorporating the length of conduit acts to dampen harmonic waves out of the yarn as the yarn is fed through the conduit 40 at high speed. In this manner, when the yarn 38 passes through the conduit 40 to enter the yarn tension device 48, the yarn will be readied to enter the ball tension device in a less excited state than when it comes off of the yarn package to thereby permit the yarn tension device 48 to function in its designed manner to apply the desired tension or drag upon the yarn 38.

The yarn tension device 48, which preferably is a ball tension device, includes a body 50 and an extended mounting arm 52 for securing the ball tension device 48 to the mounting bracket 16. The arm 52 includes an elongated opening 54 to facilitate mounting the ball tension device 48.

Figure 4:
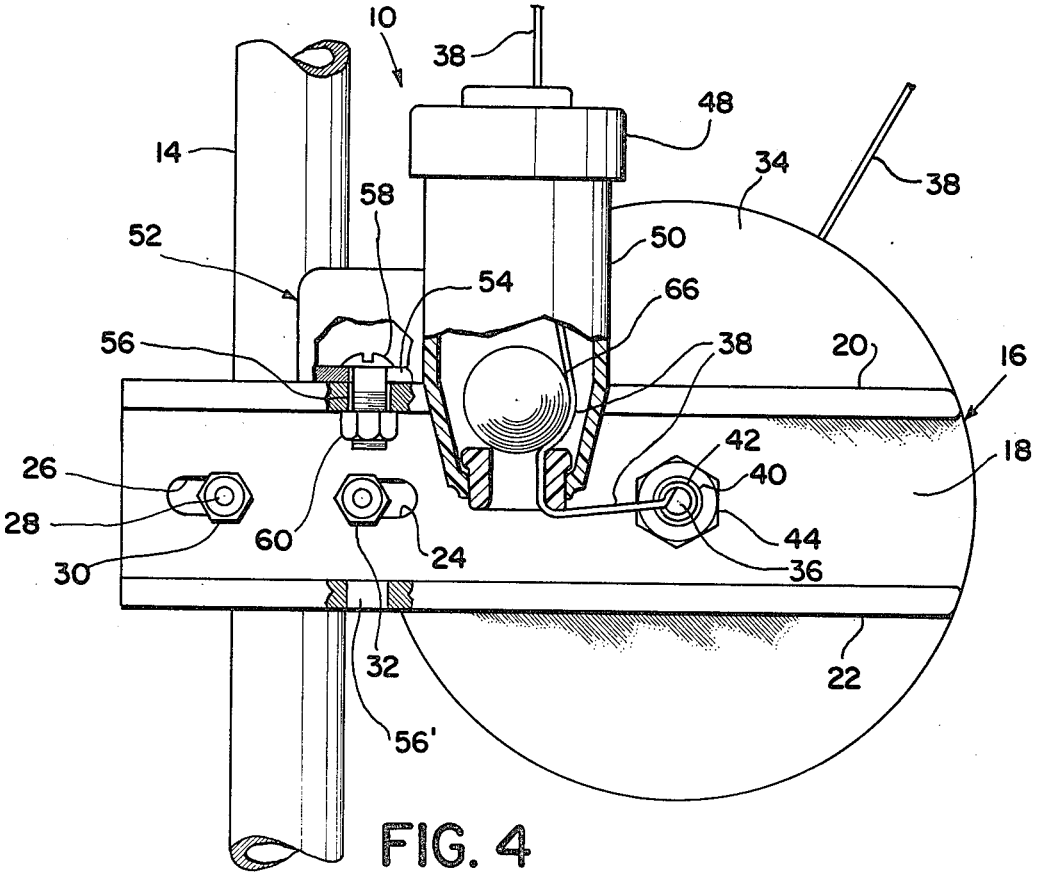
FIG. 4 is a rear elevational view of the invention looking from line 4—4 on FIG. 2, partly broken away to expose interior construction details.

As best seen in FIG. 4, both the upper bracket leg 20 and the lower bracket leg 22 are provided with mounting openings 56, 56' to facilitate connection of ball tension device 48. A usual bolt 58 and cooperating nut 60 combination can be employed to secure the ball tension device 48 to the mounting bracket 16 quite simply by inserting the bolt through the tension device elongated opening 54 and the bracket mounting opening 56 and then threadedly engaging the nut 60 upon the bolt 58 to secure the parts together. It is noteworthy that a single bolt 58 is employed to secure the tension device 48 to the mounting bracket 16. Accordingly, the orientation of the ball tension device can be readily adjusted relative to the longitudinal axis of the bracket 16 by swiveling the mounting arm 52 about the bolt 58 to achieve the desired angular orientation. Thus, tension device 48 can be secured to the mounting bracket 16 either at 90° or at some angle either more than 90° or less than 90° as may be desirable depending upon the orientation of the yarn 38 as it feeds through the device 10 toward the yarn working machine (not illustrated). Preferably, the yarn tension device 48 should be angularly oriented relative to the mounting bracket 16 so that the yarn 38 enters the device 48 at a gentle angle and leaves the device at a gentle angle. By providing the mounting openings 56,56' in both the upper leg 20 and the lower leg 22, the device becomes readily universally adaptable to either right hand mounting or left hand mounting, depending upon the construction of the yarn handling machine (not shown) itself.

In order to use the device 10, the bracket 16 is affixed to a permanent member 14 of the yarn working machine (not illustrated) such as a warping, winding, beaming, weaving, etc. or other type of machine. Depending on the machine configuration, either the bracket upper leg 20 or lower leg 22 could be positioned upwardly to thereby position the balloon control disk 34 either to the right of the permanent mounting member 14 or to the left of the member 14 as dictated by the yarn path of travel. The tension device 48 is then affixed to bracket 16 utilizing a mounting hole 56,56' in either leg 20, 22 to orient the yarn tension device upwardly. The axis of the yarn tension device mounting arm 52 may be oriented relative to the plane of the bracket web 18 at right angles thereto, slightly more than 90° or less than 90° as may be necessary or desirable depending upon the desired yarn path. As above set forth, the device functions best when yarn 38 enters the ball tension device 48 at a gentle angle and leaves also at a gentle angle. The yarn 38 is then run from the yarn package (not illustrated) through the conduit 40 and through the ball tension device 48 for yarn tensioning purposes. The yarn is then fed to the yarn working machine (not illustrated) in conventional manner.

Upon high speed operation, harmonic vibrations will be set up in the yarn 38 before it enters the conduit 40. As illustrated, the yarn 38 feeds to the conduit in angular relationship and thence axially through the conduit. The yarn then feeds from the conduit 40 in angular relationship whereby the length of the conduit (hereinbefore stated to be between $\frac{5}{8}$ of an inch and 182 of an inch) serves to dampen or remove the harmonic vibrations from the yarn before the yarn reaches the ball tension device 48. By utilizing the conduit 40 for vibration dampening purposes, the yarn 38, when it feeds through the yarn tension device 48 is in less excited state to thereby permit the balls 66 of the yarn tension device 48 to function in the designed manner for tension application purposes.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a device for feeding yarn to a textile machine, the combination of mounting bracket means adapted to affix the device to the machine, said mounting bracket means comprising a mounting bracket having a longitudinal, generally horizontal axis and being adapted for interconnecting the mounting bracket to a stationary portion of the textile machine;

balloon control means supported by the mounting bracket means to control ballooning of the yarn as the yarn is fed to the textile machine, said balloon control means comprising a hollow cylindrical conduit through which the yarn passes, said conduit being relatively long compared to the diameter of the yarn and having a horizontal axis, the vertical plane drawn through the horizontal conduit axis being at right angles to a horizontal plane drawn through the longitudinal axis of the mounting bracket, said balloon control means further comprising a circular body, said body being adapted to control ballooning of the yarn as the yarn is fed through the device;

a ball type yarn tension control having a vertical axis and a mounting arm adapted to connect the yarn tension control device to the mounting bracket means, the ball type yarn tension control receiving the yarn from the conduit of the balloon control means at an angle, the vertical axis of the yarn tension control device being so oriented that a vertical plane drawn through the vertical axis will always be at right angles to a horizontal plane drawn through the balloon control means conduit; and means to adjust the orientation of the vertical axis of the ball type yarn tension control toward and away from the horizontal axis of the balloon control means conduit to vary the angle between the horizontal axis of the balloon control means conduit and the vertical axis of the ball type yarn tension control device.

2. The device of claim 1 wherein the mounting bracket comprises an elongated, vertically disposed web and at least one horizontal leg extending from the web, the web being adapted to contact and secure the device to a portion of the textile machine.

3. The device of claim 2 wherein the balloon control means conduit is positioned in the said web in vertically spaced relationship to the said one leg.

4. The device of claim 2 wherein the mounting arm of the yarn tension control connects to the said horizontal leg.

5. The device of claim 2 wherein the said circular body is disk-shaped in configuration, the said circular body being coplanar with the said mounting bracket web.

6. The device of claim 1 wherein the mounting bracket means comprises a vertical web, a first horizontal leg extending from the web and being provided with a first opening, a second horizontal leg spaced from the first leg and extending from the web, said second leg being provided with a second opening, said second opening being spaced from the first opening, the first leg and the second leg being adapted alternately to secure the ball type yarn tension control in position by alternately positioning the first leg upwardly and utilizing a fastener inserted through the first opening and through the mounting arm of the yarn tension control or positioning the second leg upwardly and utilizing a fastener inserted through the second opening and through the mounting arm of the ball type yarn tension control, whereby the ball type yarn tension control can be readily reversible for right hand or left hand operation by rotating the said device through one hundred and eighty degrees to position either the first leg or the second leg upwardly relative to the other leg to upwardly expose either the first opening or the second opening for mounting the ball type yarn tension control.

* * * * *